US006797208B2

(12) United States Patent
Schikner

(10) Patent No.: US 6,797,208 B2
(45) Date of Patent: Sep. 28, 2004

(54) GOLF CLUB SHAFT WITH VARIABLE DENSITY TIP PLUG

(75) Inventor: Robert C. Schikner, Poway, CA (US)

(73) Assignee: Graphite Design International, San Diego, CA (US)

( * ) Notice: Subject to any disclaimer, the term of this patent is extended or adjusted under 35 U.S.C. 154(b) by 0 days.

(21) Appl. No.: 10/084,527

(22) Filed: Feb. 27, 2002

(65) Prior Publication Data

US 2003/0162606 A1 Aug. 28, 2003

(51) Int. Cl.[7] ..... B29C 70/00

(52) U.S. Cl. ..... 264/103; 156/173; 156/187; 264/257; 264/259; 264/324

(58) Field of Search ..... 264/103, 257, 264/258, 259, 313, 324, 325; 156/148, 161, 184, 173, 187; 473/316, 320, 321

(56) References Cited

U.S. PATENT DOCUMENTS 5,735,752 A * 4/1998 Antonious
5,820,483 A * 10/1998 Preece et al.
6,126,557 A * 10/2000 Preece et al.

* cited by examiner

*Primary Examiner*—Mathieu D. Vargot
(74) *Attorney, Agent, or Firm*—Myers Dawes Andras & Sherman LLP; Joseph C. Andras

(57) ABSTRACT

A golf club and a primarily non-metallic golf shaft that has an overall light weight are provided. The shaft has a weighting plug located to provide a swingweight similar to a typical steel shafted golf club. A method of making the golf club and golf shaft is simple and efficient, and centers the plug in the golf shaft. The method also provides the advantage of substantially infinitely variable plug density selection within a range of densities. A set of clubs thus made increases playability by providing a range of club weights in the set.

5 Claims, 4 Drawing Sheets

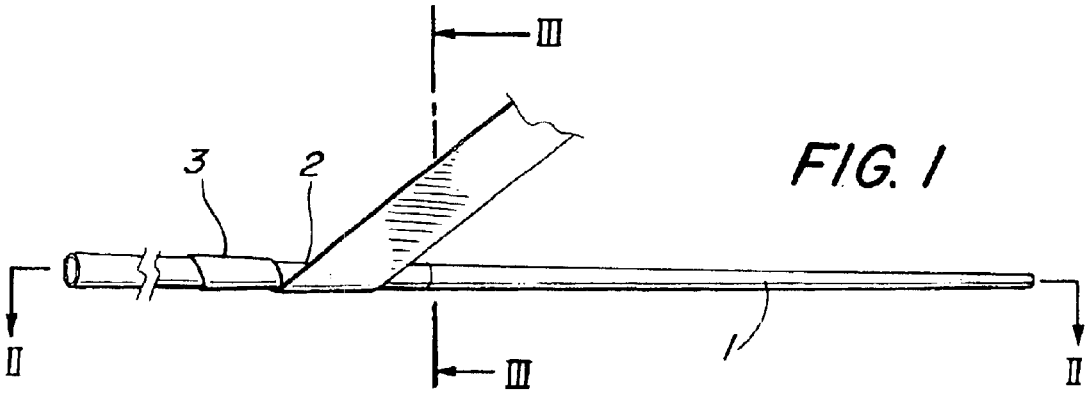
FIG. 1
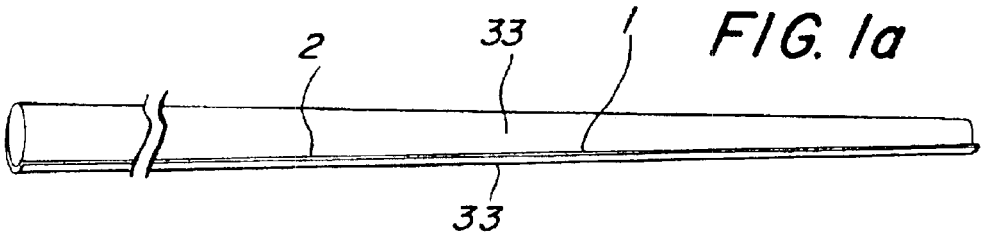
FIG. 1a
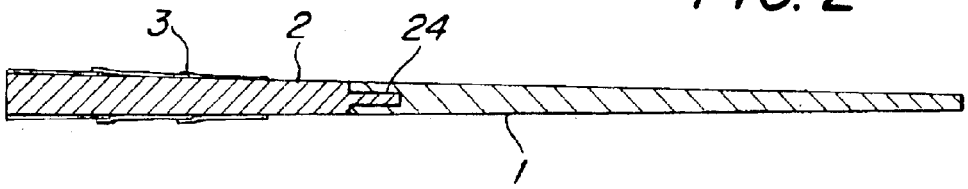
FIG. 2
FIG. 3
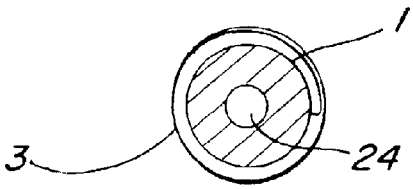

GOLF CLUB SHAFT WITH VARIABLE DENSITY TIP PLUG

BACKGROUND OF THE INVENTION

Light weight golf clubs are well known in the art and have gained a measure of popularity. The light weight golf clubs have a number of advantages including being lighter to carry and having desirable flexional characteristics. The light weight golf shafts of the prior art are more easily accelerated during swinging and better absorb the vibrations caused by striking the ball. However the light weight golf clubs of the prior art also have some disadvantages. One disadvantage of the prior art light weight golf clubs is that their light weight gives them a feel during swinging that is different from the traditional steel shafted golf clubs. The instant invention overcomes this disadvantage as set forth below.

Another disadvantage of the lightweight golf clubs is that their construction often leaves the tip end of the golf shaft opposite the handle portion weak. As a result, this is a common point of fracture in the prior art light weight clubs. U.S. Pat. No. 5,820,483 to Preece et al is directed at solving this problem by including a plug in the weak end portion. This plug structurally strengthens the end of the shaft to be inserted into the golf head. U.S. Pat. No. 6,139,444 to Renard et al among other things strengthens the tip portion of a golf shaft by a stiffener. U.S. Pat. No. 4,836,545 to Pompa similarly provides a stiffener at the tip end of the golf shaft.

U.S. Pat. No. 5,984,803 to Chappell teaches redistributing the weight of the golf club from the hosel area to the head. U.S. Pat. No. 5,685,783 to Akatsuka has a light weight golf shaft of composite materials formed by a variety of layers. This prior art device also includes attachment of the shaft to the head by an internal joint member and discloses the possibility of a core member inside the shaft. U.S. Pat. No. 5,465,959 to Cheng is directed to a composite bent shaft for a golf club. This device also has a core and a link inside a composite material shaft.

None of the prior art devices addresses the same specific need of providing a feel similar to a typical steel shafted golf club in composite materials shafted golf clubs. The closest prior art that has core or plug structure fails to provide a variety of weighting plugs for the purpose of selectively providing different weights in golf shafts. Simply stated, the prior art fails to weight golf shafts in order to increase their swing weights. Furthermore, core or plug structure that may happen to provide weight to a golf shaft fails to do so in the variable and useful way that is provided by the instant invention.

SUMMARY OF THE INVENTION

The instant invention fulfills the need for a light weight golf club that provides a swing weight similar to that of a typical steel shafted golf club. This is provided by construction of the golf shaft as a non-metal or composite shaft with a weighting plug in a tip end opposite a handle portion of the golf shaft. Thus, a shaft, a golf club, or a set of shafts or clubs constructed in accordance with the present invention provides the advantages of light weight composite shafts while also providing the advantage of providing a feel during swinging similar to that experienced during swinging of typical steel shafted clubs.

Generally, applying the invention to the making of golf shafts and corresponding golf clubs comprises the steps of:

(a) providing a light weight golf shaft with a weighting plug selected from a plurality of weighting plugs having different weights, (b) attaching a golf head to the golf shaft.

More specifically, the method includes the steps of weighting the plug and forming the plug and golf shaft into a one piece composite member.

The swing weight is made similar to that of steel shafted golf clubs by forming weighting plugs in a molding process by selectively adding higher density materials to the resin to be molded. By varying the quantity and composition of the higher density material, the weight of the weighting plug can be substantially infinitely adjustable within a predetermined range. In this way, a swing weight for a particular golf shaft or club can be selected. Likewise, the plug weights of a set of golf shafts or golf clubs can be selectively varied in a manner to increase the playability of the set. For example, the typically lighter clubs in a set can be constructed with heavier plugs so that all of the clubs in a set will have substantially the same swing weight.

BRIEF DESCRIPTION OF THE DRAWINGS

FIG. 1 is a perspective view of the mandrel and plug depicting the wrapping process.

FIG. 1*a* is a perspective view of the preferred wrapping by pre-cut prepreg material.

FIG. 2 is a sectional view taken through II—II of FIG. 1.

FIG. 3 is a sectional view taken through III—III of FIG. 1.

DETAILED DESCRIPTION OF THE PREFERRED EMBODIMENTS

Figure 4:
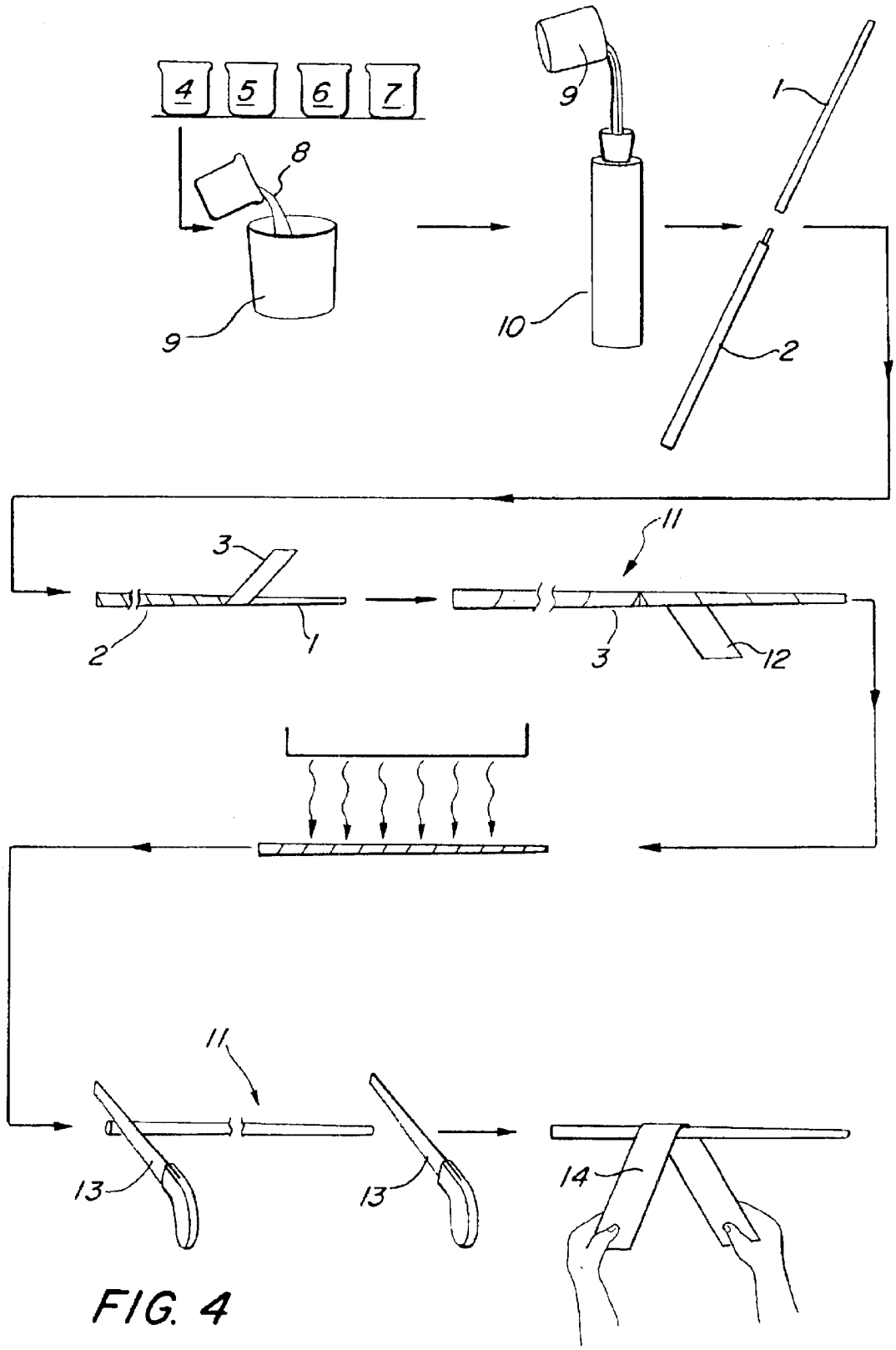
FIG. 4 is a schematic drawing showing the steps of the process of making of the present invention.

FIG. 1 shows the process of making a golf shaft 11 for a light weight golf club 18 having a high swing weight. The golf shaft 11 is formed by detachably supporting a weighting plug 1 to a mandrel 2. The golf shaft 11 is formed of thin layers of prepreg composite material windings 3 which overlap and fix the plug to the golf shaft. FIG. 1*a* shows prepreg material 33, which may be pre-cut in specific shapes and sizes in the preferred embodiment. The mandrel 2 for this process may be of steel and may have a small diameter end.

FIG. 2 is a cross sectional view showing the structure of an end of the mandrel configured in a way to removably support the plug. As shown in FIG. 3, the tip 24 of the mandrel 2 is keyed to prevent rotation of the plug relative to the mandrel 2.

FIG. 4 shows the complete method in a schematic form. The first step comprises selecting high density material(s) from the group comprising tungsten, copper, iron, and other material (4, 5, 6, 7). After selecting the composition and quantity, the next step is to add the selected high density material 8 to the weighting plug resin to form an impregnated or weighted resin 9, wherein the weighted resin 9 has a higher density than a non-impregnated or non-weighted resin 8. Next the weighted resin 9 is added to the mold 10 to form the plug. An end of the weighting plug is molded with structure to releasably receive an end of the mandrel. When the plug is fully cured it is ready to be placed on the mandrel for the wrapping process. The mandrel and plug are wrapped with thin layers of a prepreg composite fibrous material. (The fibers of the prepreg material may be carbon fibers.) In the preferred embodiment, the mandrel and plug are wrapped by thin layers of prepreg material 33, which have been cut to size as shown in FIG. 1*a*. Then the composite material, mandrel and weighting plug are wrapped with a cellophane or polypropylene tape and are hardened and cured by heating. After curing, the tape is removed from the composite, mandrel, and weighting plug and the mandrel is removed from the composite material. At this stage the composite material forms the shaft 11 and the wrapping and curing steps have fixed the plug 1 in a tip end of the golf shaft 11. Next the ends of the shaft 11 are cut off. Then the golf shaft is sanded and finished. Each shaft 11 is prepared in this way for attachment to a head to form a golf club.

Figure 5:
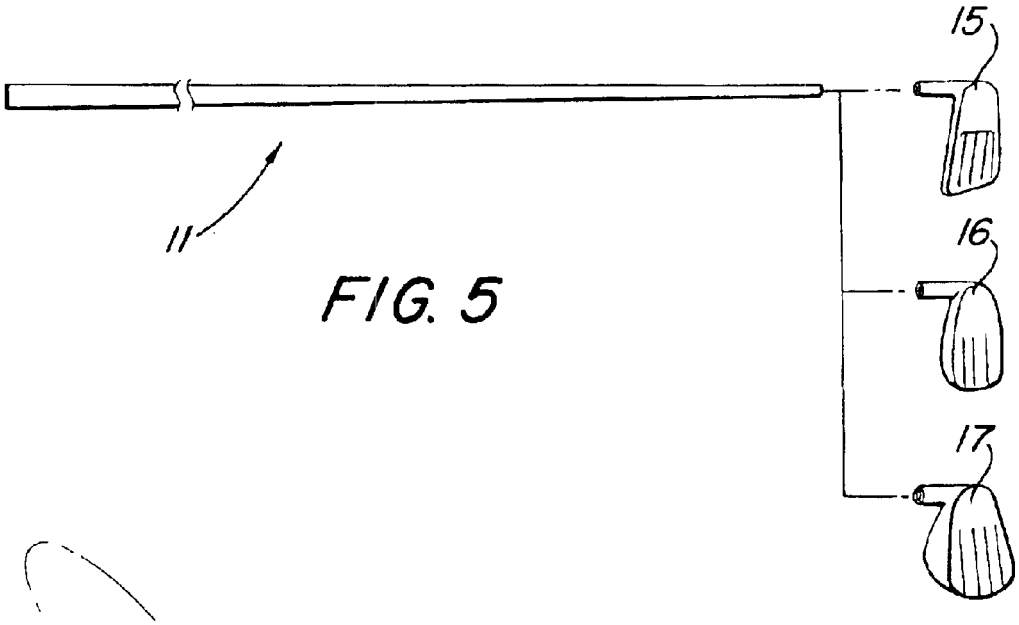
FIG. 5 is a schematic drawing showing a variety of heads that can be applied to a shaft of the instant invention.

FIG. 5 shows the step of selectively choosing a particular golf head from among irons, woods, and drivers 15, 16, 17 for the golf shaft 11. The golf head may comprise any combination of the group of materials comprising wood, metal, plastic, and composites. In reality the section process is more extensive. The length of the shaft needs to be selected. The position of the weighting plug also needs to be selected. This is achieved by locating the weighting plug in the shaft for the desired balance point and swing weight. The particular density plug, and thus its weight, is selected in light of the particular golf head to be attached and the length of the golf shaft to be used. The desired density plug is fixed in the end of the shaft by the wrapping and curing steps set forth above. In this way, a set of shafts and hence a set of clubs can be made to enhance playability.

The plug 1 is fixed in the end of the golf shaft 11 opposite the handle portion of the golf shaft by wrapping or winding thin layers of prepreg material onto the weighting plug 1 and the mandrel 2 in a predetermined order. Efficiency is achieved by simultaneously providing weight and closing a hole in the end of the golf shaft 11 by the weighting plug 1. The material wrappings or windings 3 overlap and fix the plug 1 to the shaft, which is simultaneously formed by the material wrappings or windings 3 on the mandrel. In this way the plug 1 and golf shaft 11 are made to form a one piece composite that is monolithic, and which appears to be of a single material.

Figure 6:
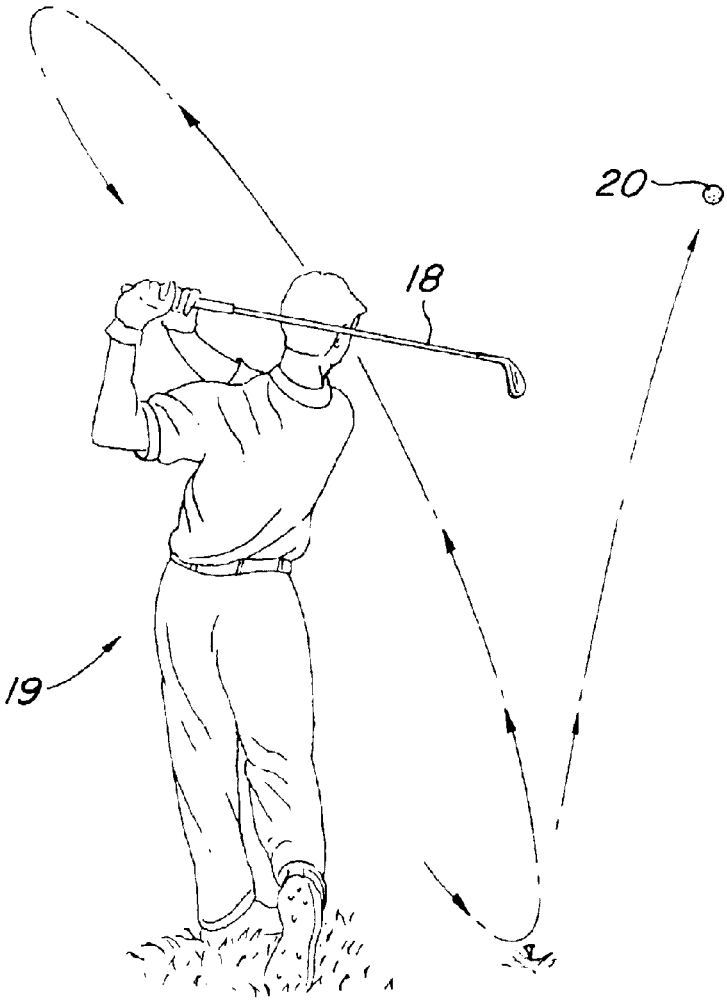
FIG. 6 is a perspective view showing a golfer using a golf club of the present invention.

FIG. 6 depicts the use of a light weight golf club in accordance with the present invention. The user of a set of clubs of the present invention has the opportunity of using a golf club that is lighter than a typical steel shafted golf club and yet has the same feel during swinging as the typical heavier steel shafted golf club. This is made possible since the lighter golf club has been weighted such that the lighter golf club swingweight is similar to that of the typical steel shafted golf club. The method of using comprises swinging the lighter golf club with similar forces to those applied when swinging the steel shafted golf club. The result is a feeling of opposite forces on the hands of the user during acceleration of the lighter golf club similar to the feeling that would be felt when using the steel shafted golf club. Typically the method of the instant invention is not applied to putter shafts since swinging a putter is distinct from swinging the other clubs in a set. However, the process may be applied to putters to achieve a desired weighting in putters.

A steel shaft of a typical steel shafted golf club has a mass greater than 100 grams. The typical light weight composite shafts have weights of less than 100 grams. By locating a high density weighting plug 1 in a composite shaft 11 in accordance with the instant invention, it is possible to provide a balance point closer to the tip end such that the swing weight of the light weight composite shaft is similar to that of the heavier steel shaft.

Figure 7:
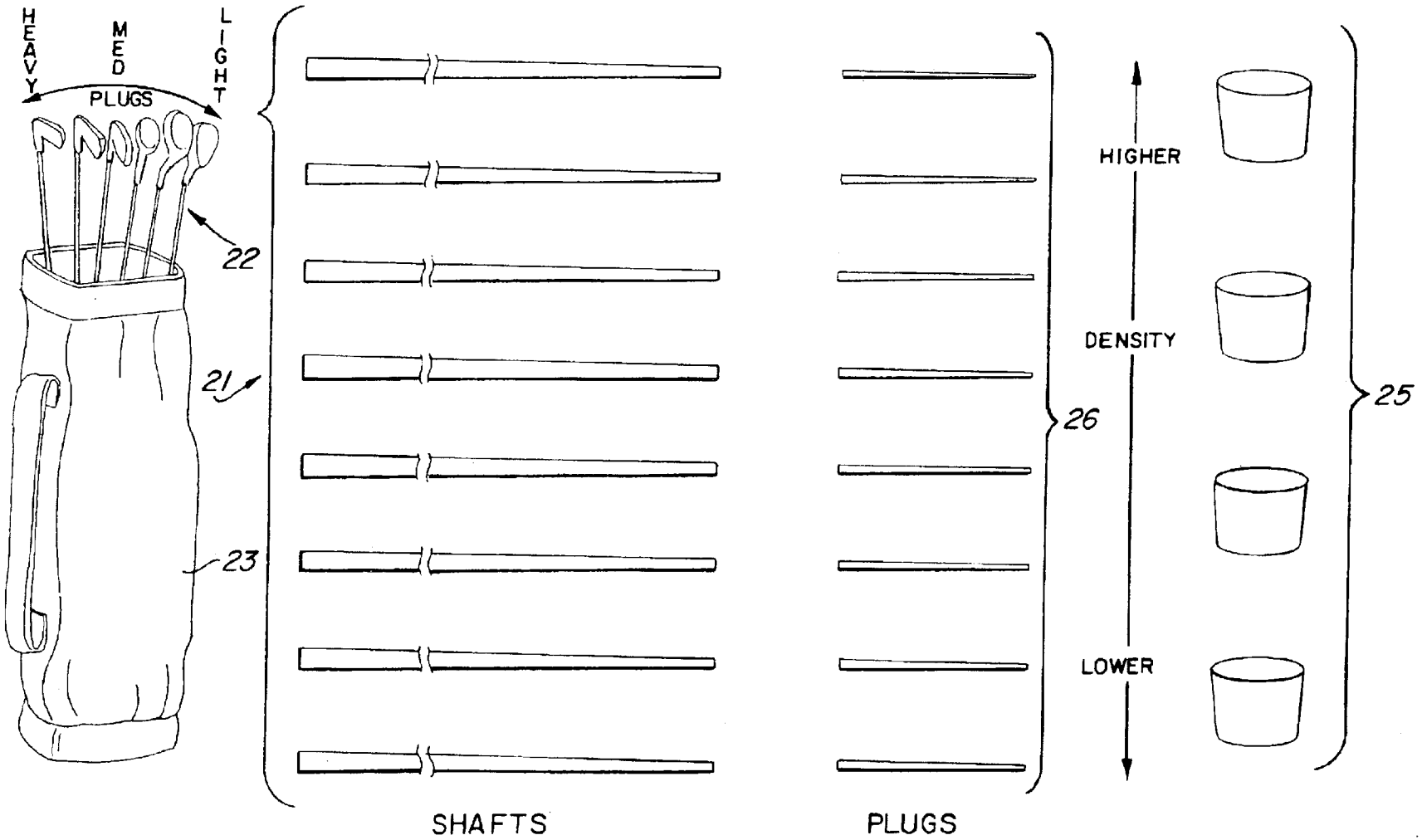
FIG. 7 is a schematic drawing depicting a possible weighting strategy for increasing playability of a set of clubs made in accordance with the present invention.

FIG. 7 is a schematic representation of how the selection process of higher density materials 25 for impregnating or weighting the plug resin 9, and the selection of a resulting plugs 26 determines the playability of a set of shafts 21 and a corresponding set of golf clubs 22. In making the shafts, the weighting plug for each golf shaft is selected to provide a range of golf shaft weights. The shaft weights are selected to provide consistency of swing weights in a set of golf clubs constructed from the shafts. Thus, playability of a set of clubs made from the set of golf shafts is enhanced.

The plug material 9 comprises carbon fiber reinforced polycarbonate. The plug material is selected to provide of a variety of plugs ranging in weight. Specifically, the plug material is selected to provide a variety of plugs ranging in weight by 50% relative to a minimum plug weight. The minimum plug weight is achieved when no weighting material is added to the carbon fiber composite material of a tip plug. In fact, the minimum plug weight is achieved when a maximum amount of carbon fiber is added to the resin.

Specifics of the invention have been set forth above and in the accompanying drawings. However, there are many aspects of the invention that have not been explicitly described, yet that are within the spirit and scope of the invention. Thus, the invention is to be limited only by the appended claims.

I claim:

1. A method of making a light weight golf club for reducing the overall weight of the golf club while providing a swingweight similar to that of a typical steel shafted golf club, the method comprising the steps of:

(a) forming a plurality of weighting plugs of different weight by combining different amounts of a dense weighting material with a moldable resin to form differently weighted combinations and curing the differently weighted combinations in a suitable mold;

(b) forming a light weight golf shaft by:

(1) providing a mandrel;

(2) selecting a weighting plug from the plurality of weighting plugs of different weight;

(3) removably attaching the selected weighting plug to a tip end of the mandrel;

(4) forming the golf shaft by rolling thin layers of prepreg composite materials onto the mandrel and weighting plug in a predetermined order;

(5) hardening and curing the golf shaft by heating, the plug and golf shaft being formed into a one piece composite member; and (6) removing the golf shaft and associated plug from the mandrel; and (c) attaching a golf head to the golf shaft.

2. The method of claim 1 wherein making the light weight golf club comprises making a light weight golf shaft with a swingweight of a typical steel golf shaft, the method further comprising:

(a) forming the golf shaft of composite plastic materials of total mass less than 100 g, (b) positioning a balance point of the light weight golf shaft such that the force required for a particular swing acceleration is substantially equivalent to a force required for the same swing acceleration of the typical steel golf shaft having a total mass of over 100 g.

3. The method of claim 1 wherein the step of forming a plurality of weighting plugs of different weight further comprises the step of selectively varying the weight of the weighting plugs by up to 50% relative to a minimum plug weight.

4. The method of claim 1, the steps further comprising the step of selectively choosing the golf head and plug based on a selection of plugs varying in weight by 50% relative to a minimum plug weight.

5. The method of claim 1 wherein the dense weighting material used in the step of forming a plurality of weighting plugs of different weight is selected from the group of different density materials comprising: tungsten, copper, and iron.

* * * * *